US006627874B1

(12) United States Patent
Yefchak

(10) Patent No.: US 6,627,874 B1
(45) Date of Patent: Sep. 30, 2003

(54) PRESSURE MEASUREMENT USING ION BEAM CURRENT IN A MASS SPECTROMETER

(75) Inventor: George Yefchak, Sant Clara, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/520,638

(22) Filed: Mar. 7, 2000

(51) Int. Cl.[7] ..... G21K 5/00

(52) U.S. Cl. ..... 250/281; 250/282; 250/288; 250/492.2; 250/492.21; 250/397; 250/398

(58) Field of Search ..... 250/281, 288, 250/306, 307, 492.2, 492.21, 398, 397, 282, 287

(56) References Cited

U.S. PATENT DOCUMENTS 4,587,433 A 5/1986 Farley ..... 250/492.2
4,625,112 A 11/1986 Yoshida ..... 250/287
4,652,752 A 3/1987 Ino et al. ..... 250/281
5,111,042 A * 5/1992 Sullivan et al. ..... 250/251
5,644,220 A 7/1997 Urs et al. ..... 324/71.3
5,834,770 A 11/1998 Holkeboer et al. ..... 250/281
5,866,901 A 2/1999 Penn et al. ..... 250/281

* cited by examiner

*Primary Examiner*—John R. Lee
*Assistant Examiner*—David A. Vanore

(57) ABSTRACT

Method and apparatus for rapid monitoring of pressure in a chamber equipped with a mass spectrometer by using the primary beam current in conjunction with a conventional pressure gauge. The conventional gauge allows frequent calibration of the relationship of the beam current to the chamber pressure, preventing excessive drift in the system. An advantage of the system is that it takes advantage of instruments already present in a typical spectrometry apparatus.

17 Claims, 2 Drawing Sheets

PRESSURE MEASUREMENT USING ION BEAM CURRENT IN A MASS SPECTROMETER

FIELD OF THE INVENTION

The present invention relates to pressure measurement in conjunction with mass spectrometry, and in particular to continuous pressure measurement by monitoring of ion beam current.

BACKGROUND OF THE INVENTION

Mass spectrometry is now widely used in a variety of fields. In particular, it is used to monitor and control a number of processes in semiconductor fabrication, including chemical and physical vapor deposition and ion implantation. Accurate measurement and control of fabrication processes is essential in semiconductor manufacture. One important parameter to be measured in many processes is the total chamber pressure.

Pressure in vacuum chambers can be measured using a variety of devices, including thermocouple gauges, ionization gauges, rotating-disc viscosity gauges, and others. The type of gauge used in any particular system is generally selected according to considerations of cost, desired accuracy, and expected pressure range. Typically, pressures in the millitorr range are measured with a thermocouple gauge or other gauge that measures heat dissipation, whose readout times depend on the mass of the heated element and the heat transfer coefficient. These gauges cannot practically deliver pressure data at rates faster than a few Hz. Even commercial ultra low pressure ion beam gauges provide discrete readouts at only moderate frequencies, e.g., about 1 Hz.

Semiconductor manufacturing lines currently do not dynamically use pressure data to control deposition rates or other process parameters. While pressure may be monitored during the fabrication process, the low data rates of the pressure gauges described above make it infeasible to use them for process control.

Much faster pressure readings can be obtained by monitoring the primary ion beam current in the collector of a mass spectrometer. The ion beam current is related to the ion source pressure, which can in turn be related to chamber pressure. Such a system is described, for example, in U.S. Pat. No. 5,834,770 to Holkeboer et al. Unfortunately, pressure readings obtained in this way are often not particularly stable. "Drift" in the relationship between beam current and ion source pressure can occur as the source parameters are varied (e.g., to tune the instrument), as the source becomes dirty, as the source filament ages, or for other reasons. Thus, primary beam current is rarely used to monitor pressure in these systems.

A need therefore still exists for a system which can provide fast (preferably continuous), accurate pressure measurement in mass spectrometry systems.

SUMMARY OF THE INVENTION

The present invention allows rapid monitoring of pressure in a chamber equipped with a mass spectrometer by using the primary beam current in conjunction with a conventional pressure gauge. The conventional gauge allows frequent calibration of the relationship of the beam current to the chamber pressure, preventing excessive drift in the system. An advantage of the system is that it takes advantage of instruments already present in a typical spectrometry apparatus.

In one aspect, the invention comprises apparatus for monitoring chamber pressure, including an ion source which produces an ion beam, a collector where beam current can be continuously measured, and a pressure gauge which can be used to obtain a series of discrete pressure measurements (e.g., at a rate of less than about 100 Hz, or at a rate of less than about 1 Hz). The apparatus further comprises analysis means which combine the beam current measurement and the pressure gauge measurements to continuously determine the chamber pressure, for example by using the beam current to determine an offset to the most recently measured gauge pressure. The apparatus may comprise orthogonal acceleration means that allow the ion beam to be used in time-of-flight mass spectrometry, or the ion beam may be a component of another type of mass spectrometer.

In another aspect, the invention comprises methods of monitoring chamber pressure in a chamber equipped with a pressure gauge, an ion source that produces an ion beam, and an ion collector from which a beam current can be measured. The methods include monitoring the pressure gauge to obtain a series of discrete pressure measurements (e.g., at a rate of less than about 100 Hz, or at a rate of less than about 1 Hz), and continuously monitoring the beam current (e.g., at a rate of at least about 1 kHz, 10 kHz, or 50 kHz). The continuous beam current measurement and the discrete pressure measurements are then combined to yield a continuous chamber pressure measurement. The continuous pressure measurement may serve as an input to an automated process control system.

BRIEF DESCRIPTION OF THE DRAWING

The invention is described with reference to the several figures of the drawing, in which.

DETAILED DESCRIPTION

Figure 1:
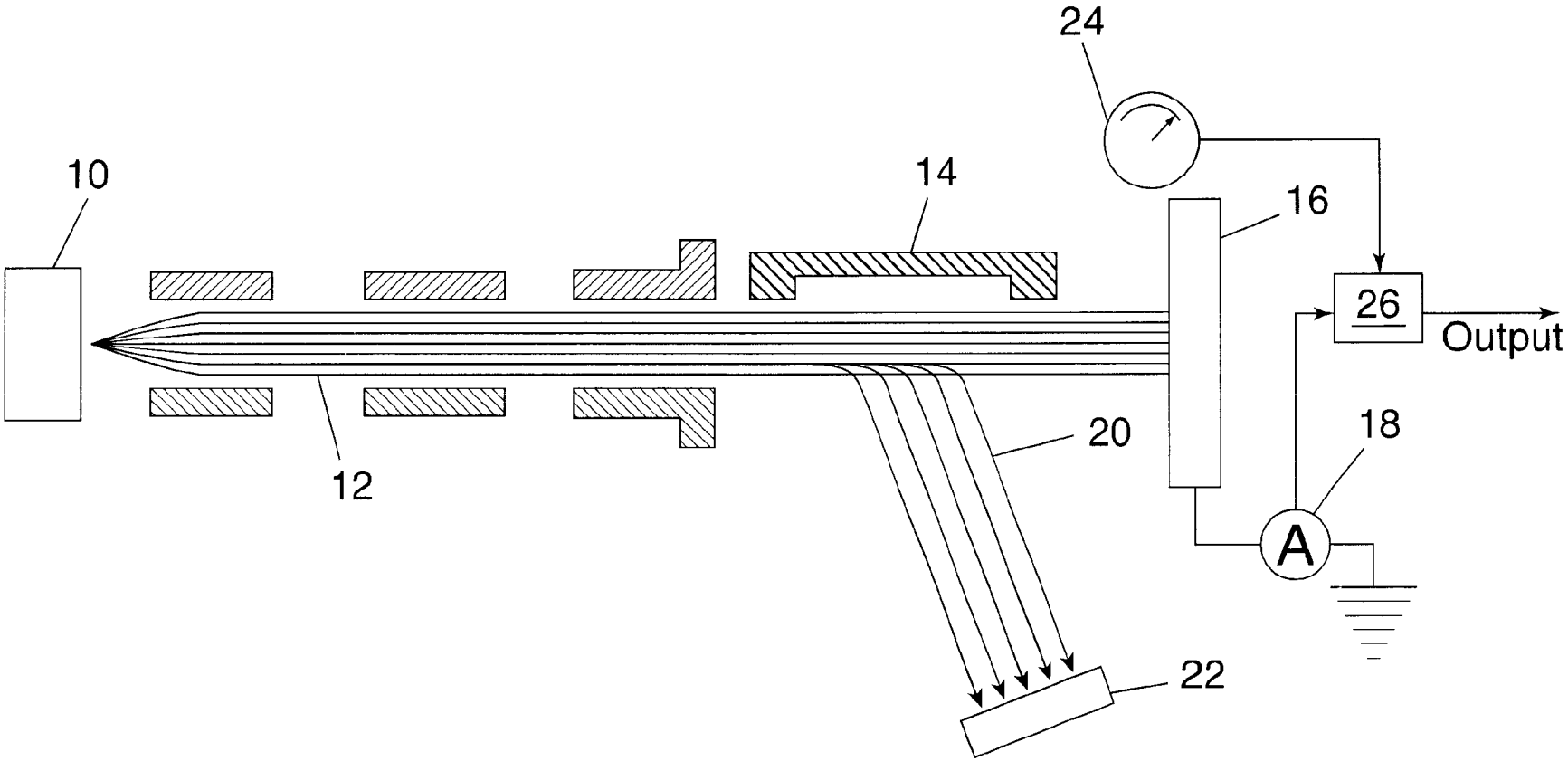
FIG. 1 is a schematic diagram of a time-of-flight mass spectrometer.

FIG. 1 shows a time-of-flight mass spectrometer according to one embodiment of the invention. The ion source 10 emits a primary ion beam 12, which is focused and/or collimated. An orthogonal accelerator 14 applies carefully timed voltage pulses to deflect a fraction of the ions 20 into a secondary collector 22 for mass analysis. The remainder of the ions continue undeflected to the primary collector 16. The current due to these ions striking the collector 16 is measured at ammeter 18 to determine the beam current (the ammeter 18 may be an electrometer which amplifies small currents into measurable voltages). A separate conventional pressure gauge 24 also measures the pressure in the chamber; the ammeter 18 and the pressure gauge 24 are connected to a processor 26.

When the fraction of ions being deflected to the secondary collector 22 is known, the current at the primary collector 16 can be corrected to determine the ion source pressure (the number of ions leaving the ion source 10). The ion source pressure is a function of the chamber pressure (among other parameters). Thus, the beam current can be used to determine the pressure in the chamber. Beam current can be read at rates as fast as 50 kHz, effectively continuously. (In this disclosure, measurement rates greater than about 1 kHz are treated as continuous).

As discussed above, beam current alone is not generally used to monitor pressure, because it can vary with changes in instrument tuning, as the ion source becomes "dirty," as a source filament ages, or in response to other perturbations of the spectrometry system. All of these changes typically take place over a timescale of minutes or even hours, however. According to the invention, the effects of these perturbations can be greatly reduced or even eliminated by calibrating the relationship between beam current and pressure by reference to the conventional pressure gauge on a frequent basis.

In preferred embodiments, the ammeter 18 and the pressure gauge 24 are connected to analog-to-digital converters (not shown) to produce digital signals. These signals are combined in a data processor 26, which generates a combined signal that may be used for process control as described below. The data processor may comprise a computer running standard data capture software, such as National Instruments' LabView™, or it may be a custom processor. Alternatively, the analog-to-digital converters may be omitted, and the processor 26 may be an electrical circuit used to combine the ammeter and pressure gauge signals to produce an analog output.

In preferred embodiments of the invention, the relationship between beam current and pressure is recalibrated at the reading frequency of the pressure gauge. This relationship is shown schematically in the graph of FIG. 2. Solid line 30 represents the actual chamber pressure as a function of time. This pressure is measured by the pressure gauge at points 32. The pressure at times between the pressure gauge measurements is determined by reference to the beam current, as shown by dotted segments 34. These measurements may deviate from the true pressure as shown, as "drift" in pressure measurement occurs (deviations have been exaggerated in FIG. 2 for clarity). At each gauge measurement, the calibration of the beam current/pressure relationship is reset, and changes in pressure from the newly determined gauge pressure are calculated using the beam current.

In other embodiments of the invention, less frequent pressure gauge measurements may be used. For example, the "true" pressure may be measured once a minute or even less frequently, as long as the interval is short compared to the timescale of drift of the beam current/pressure relationship.

Figure 2:
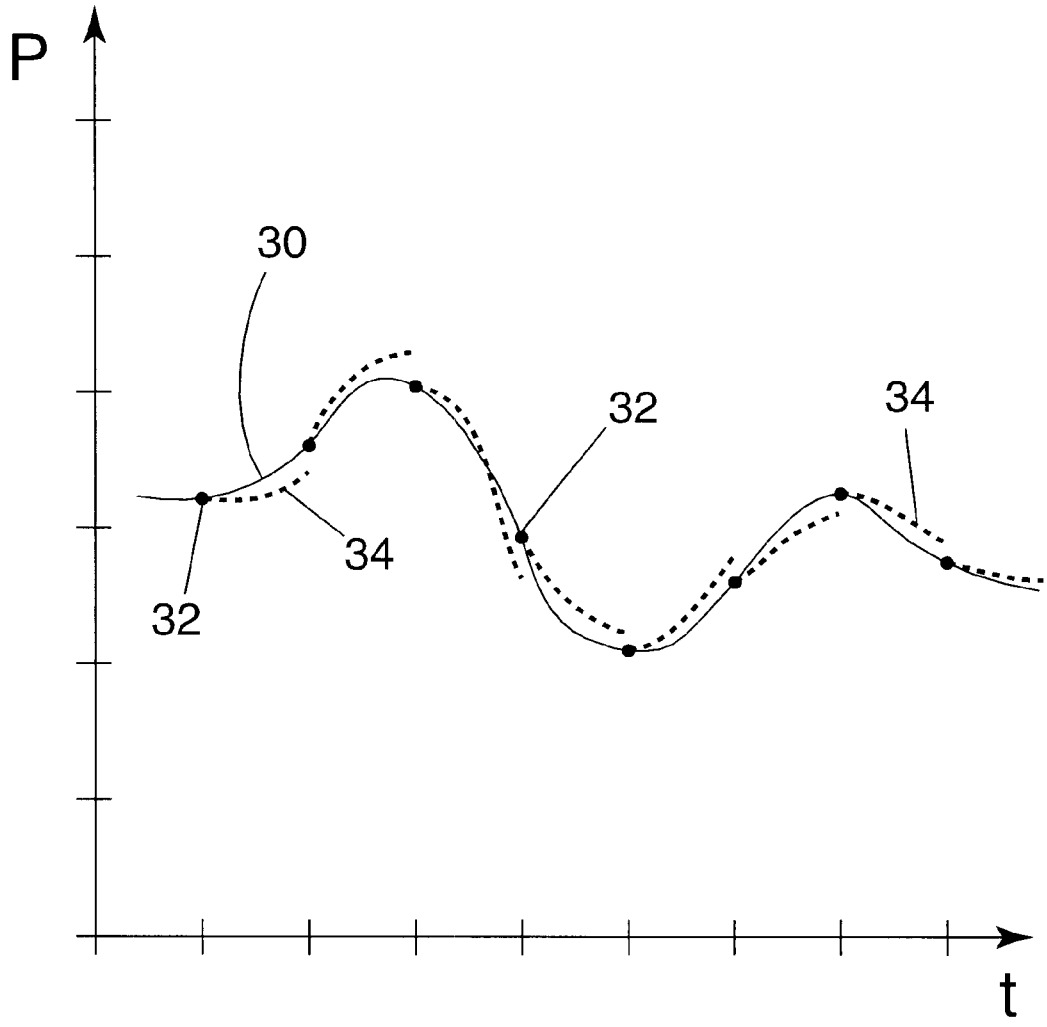
FIG. 2 is a graph showing absolute pressure and measured pressure as a function of time.

Comparison of the pressure gauge and beam current measurements to produce the curve of FIG. 2 may be performed by standard circuits familiar to those skilled in the art, or by computer-based measurement and acquisition systems. These measurements may then be directly displayed on a monitor or other output means, or may be used to provide feedback for process control, for example for concentration monitoring in deposition systems. Even if a dynamic feedback system is not used, the pressure measurement system of the invention can be used to very quickly cut off a plasma torch during deposition in response to a pressure fluctuation outside normal tolerances. Such a cut-off system reduces the risk of destroying a wafer which may be worth many thousands of dollars.

Other embodiments of the invention will be apparent to those skilled in the art from a consideration of the specification or practice of the invention disclosed herein. It is intended that the specification be considered as exemplary only, with the true scope of the invention being indicated by the following claims.

What is claimed is:

1. Apparatus for monitoring pressure in a chamber, comprising, an ion source which produces an ion beam;

an ion collector which collects the ion beam to produce a beam current;

an ammeter for continuously; measuring the beam current;

a pressure gauge which measures the pressure of the chamber in a series of discrete measurements; and a data processor which combines the measured beam current and the measured gauge pressure to continuously determine the pressure in the chamber.

2. The apparatus of claim 1, wherein the data processor combines the measured beam current and the measured gauge pressure by using the most recently measured gauge pressure as a base pressure and using the beam current to determine deviation from the base pressure.

3. The apparatus of claim 1, further comprising orthogonal acceleration means for deflecting the ion beam to perform time-of-flight mass spectrometry.

4. The apparatus of claim 1, wherein the series of discrete measurements are taken at a frequency not greater than about 100 Hz.

5. The apparatus of claim 1, wherein the series of discrete measurements are taken at a frequency not greater than about 1 Hz.

6. The apparatus of claim 1, wherein continuously monitoring beam current comprises measuring beam current at a frequency of at least 1 kHz.

7. The apparatus of claim 1, wherein continuously monitoring beam current comprises measuring beam current at a frequency of at least 10 kHz.

8. The apparatus of claim 1, wherein continuously monitoring beam current comprises measuring beam current at a frequency of at least 50 kHz.

9. The apparatus of claim 1, wherein the ion beam is a component of a mass spectrometer.

10. A method of monitoring pressure in a chamber having a pressure gauge, an ion source and an ion collector, the ion source producing an ion beam which is collected by the ion collector to produce a beam current, comprising, monitoring the pressure gauge to determine a discrete series of base chamber pressure measurements;

continuously monitoring the beam current; and using the beam current and the base chamber pressure measurements to continuously determine a corrected chamber pressure measurement.

11. The method of claim 10, wherein the corrected chamber pressure measurement is determined by combining the measured beam current and the measured gauge pressure by using the beam current to determine deviation from the most recently measured base chamber pressure.

12. The method of claim 10, further comprising using the determined corrected chamber pressure measurement as input to an automated process control system.

13. The method of claim 10, wherein the series of base chamber pressure measurements are taken at a frequency not greater than about 100 Hz.

14. The method of claim 10, wherein the series of base chamber pressure measurements are taken at a frequency not greater than about 1 Hz.

15. The method of claim 10, wherein continuously monitoring beam current comprises measuring beam current at a frequency of at least 1 kHz.

16. The method of claim 10, wherein continuously monitoring beam current comprises measuring beam current at a frequency of at least 10 kHz.

17. The method of claim 10, wherein continuously monitoring beam current comprises measuring beam current at a frequency of at least 50 kHz.

* * * * *